United States Patent [19]

Daussan et al.

[11] Patent Number: 4,792,070

[45] Date of Patent: Dec. 20, 1988

[54] TUBES FOR CASTING MOLTEN METAL

[75] Inventors: Jean Daussan; Gérard Daussan, both of Metz; André Daussan, Longeville-les-Metz, all of France

[73] Assignee: Daussan et Compagnie, Woippy, France

[21] Appl. No.: 85,184

[22] Filed: Aug. 14, 1987

Related U.S. Application Data

[63] Continuation of Ser. No. 800,167, Nov. 20, 1985, abandoned, which is a continuation-in-part of Ser. No. 523,285, Aug. 15, 1983, abandoned.

[30] Foreign Application Priority Data

Aug. 23, 1982 [CH] Switzerland ..... 4992/82

[51] Int. Cl.[4] ..... B22D 41/08

[52] U.S. Cl. ..... 222/606; 164/437; 164/337; 222/591

[58] Field of Search ..... 222/606, 607, 591; 266/280, 282; 75/95; 164/337, 437

[56] References Cited

U.S. PATENT DOCUMENTS

| | | | |
|---|---|---|---|
| 1,997,988 | 4/1935 | Wever | 75/95 X |
| 2,711,954 | 6/1955 | West et al. | 75/95 X |
| 3,192,582 | 7/1965 | Cope et al. | 222/591 X |
| 3,229,970 | 1/1966 | Henry | 266/280 |
| 3,934,640 | 1/1976 | Neumann et al. | 222/591 X |
| 4,096,976 | 6/1978 | Daussan | 222/591 |
| 4,210,264 | 7/1980 | Kondo | 222/591 |
| 4,257,473 | 3/1981 | Mills | 164/437 X |
| 4,339,115 | 7/1982 | Daussan et al. | 266/280 |
| 4,360,133 | 11/1982 | Debaise | 222/591 X |
| 4,401,243 | 8/1983 | Diederich et al. | 222/591 |
| 4,423,833 | 1/1984 | Richter | 164/437 X |
| 4,432,396 | 2/1984 | Daussan et al. | 222/591 X |
| 4,568,007 | 2/1986 | Fishler | 222/606 |

FOREIGN PATENT DOCUMENTS

| | | |
|---|---|---|
| 0583050 | 5/1944 | United Kingdom . |
| 0066492 | 12/1982 | European Pat. Off. . |
| 2423358 | 11/1975 | Fed. Rep. of Germany . |
| 2609769 | 6/1977 | Fed. Rep. of Germany . |
| 2919880 | 11/1980 | Fed. Rep. of Germany . |
| 2333599 | 7/1977 | France . |
| 2433995 | 3/1980 | France . |
| 0141566 | 11/1980 | Japan . |
| 0027967 | 2/1982 | Japan . |
| 0038380 | 3/1982 | Japan . |

*Primary Examiner*—Joseph J. Rolla
*Assistant Examiner*—Nils E. Pedersen
*Attorney, Agent, or Firm*—Young & Thompson

[57] ABSTRACT

A tube for continuous casting of molten metal is composed of a thin sheet-metal cladding and of an internal lining of heat-insulating material which is sinterable at the casting temperatures involved. The upper end of the casting tube is attached in air-tight manner to the discharge outlet of a first vessel for containing molten metal. The lower end of the casting tube dips into the molten metal of a second vessel located downstream with respect to the first vessel. In conjunction with the sheet-metal cladding, the casting tube comprises a tubular reinforcement member embedded within the lining material. The reinforcement member extends to the full depth of that portion of the casting tube which is in contact with the molten metal.

8 Claims, 2 Drawing Sheets

TUBES FOR CASTING MOLTEN METAL

This application is a continuation of application Ser. No. 800,167 filed 11/20/85, abandoned, which is a continuation-in-part of the patent application Ser. No. 523,285, filed 8/15/83, abandoned.

The present invention relates to casting tubes for conducting molten metal in transfer operations.

Practical experience in this field has shown that all casting tubes of insulating material, and especially those described in French Pat. Nos. 2,333,599 and 2,433,995 are subject to certain disadvantages and limitations which the present invention proposes to overcome.

In particular, in the forms of construction described with reference to FIGS. 5, 6 and 7 of French Pat. No. 2,333,599, it has been found in practice that the casting tube exhibits deficient air-tightness at the beginning of casting operations. As the molten steel flows down the casting tube, the interior of the tube is in fact subjected to a succession of positive and negative pressures. When the interior of the tube is at a negative pressure or partial vacuum, the above-mentioned designs of the prior art allow air to pass to the steel through the pores of the insulating material and through the holes of the perforated reinforcement member, which is liable to affect the purity of the steel at the beginning of the casting operation.

However, the embodiments described with reference to FIGS. 1, 3 and 4 of the patent cited above are not subject to this particular disadvantage by virtue of the fact that the casting tube is provided with a continuous sheet-metal cladding. On the other hand, when the end of said casting tube is immersed in the molten steel, the sheet-metal cladding which comes into contact with the steel is heated to a temperature such that it either melts or else completely looses its mechanical strength. As the steel flows down within the casting tube, the overpressure which exists within said tube often results in fracture of the entire immersed portion of this latter since the insulating material of said tube does not have sufficient strength. The debris thus produced are liable to form scoria within the steel. Furthermore, the jet of molten steel is thus liable to be put into contact with the surrounding air.

In order to provide a remedy for this situation, it has also been proposed to mount an external reinforcement sleeve around the immersible end of the casting tube (show in FIG. 1 of French Pat. No. 2,433,995, said reinforcement sleeve being directly attached to the sheet-metal cladding of the casting tube. The aim of this expedient is to prevent the molten steel from destroying the metal cladding of the immersible portion of the casting tube. While this protection often proves to be effective, a disadvantage nevertheless arises from the need to increase the external diameter of the tube end, thus in turn increasing the weight and capital cost involved. A tedious requirement is also imposed on the user when it proves necessary under certain circumstances to fit the sleeve on the casting tube at a service location.

In order to overcome this drawback, a logical expedient open to anyone versed in the art would be to increase the strength of the insulating material by increasing its thickness. This clearly has the disadvantage, however, of increasing the weight and cost while at the same time reducing the ease of handling of the casting tube. Another logical answer to the problem would be to increase the thickness of the sheet-metal cladding or its resistance to melting but the same disadvantages would again be encountered.

The French Pat. No. 2,333,599 also describes a casting tube made from sinterable material which is reinforced internally by a metallic sleeve associated with anchoring means such as a perforated sheet-metal element or a wire-mesh element. However this metallic sleeve has a thermal expansion considerably different from that of the sinterable lining and thus craks are formed in said lining. These cracks create passages in the lining which enables the molten metal to come into contact with the metallic sleeve and melt the latter.

The object of the present invention is to remove the disadvantages mentioned in the foregoing.

In accordance with the invention, the casting tube is composed of a thin sheet-metal cladding and of an internal lining of heat-insulating material which is sinterable at the casting temperatures involved. The upper end of said casting tube is attached in a substantially airtight manner to the discharge outlet of a vessel for containing molten metal. The lower end of the casting tube dips into the molten metal of a second vessel located downstream with respect to the first vessel. In conjunction with the sheet-metal cladding, the casting tube essentially comprises a tubular reinforcement member embedded within the lining material. Said reinforcement member extends to the full depth of that portion of the tube which is in contact with the molten metal.

The reinforcement member is constituted by a layer of material which has high mechanical strength and is different from the lining material, said material of said layer being chosen among the group consisting of:

A—carbon fibers, graphite fibers, ceramic fibers, mineral fibers and mixtures of said fibers, said fibers being woven or not woven.

B—refractory particles joined together by the means of a binder, said particles being chosen among the group comprising $SiO_2$ or MgO as main components, CaO, $Al_2O_3$, $Fe_2O_3$, wherein, when the lining of the casting tube contains as main component $SiO_2$ and is of acid nature, the tubular reinforcement layer contains MgO as main component and is of basic nature and wherein, when the lining of the casting tube contains as main component MgO and is of basic nature, the tubular reinforcement layer contains $SiO_2$ as main component and is of acid nature, C—metal particles chosen among the group comprising Mg, Fe, Zn, Ca, Mn, Co, Ni and mixtures thereof mixed with $Al_2O_3$, said mixture being converted into an oxide double of aluminum and of the metal(s) chosen among the above group under the heat involved by the molten metal casted into the casting tube.

The unexpected result found by practical experience is that said reinforcement member is capable of preventing the immersed portion of the casting tube from breaking-away as it comes into contact with the surrounding molten metal when the sheet-metal cladding has either disappeared or lost its resistance.

The casting tube as thus arranged has a wide range of potential applications. The tube can thus be mounted beneath the discharge outlet of a vessel for molten metal such as a casting ladle or a transfer vessel and can form part in particular of a slide-valve system which is capable to transverse displacement with respect to the axis of the casting tube.

The casting tube can also constitute a removable nozzle which is engaged in the top end of a casting tube proper and connects this latter in air-tight manner to the discharge outlet of the casting vessel located upstream.

Other features of the invention will be more apparent upon consideration of the accompanying drawings, wherein.

Figure 1:
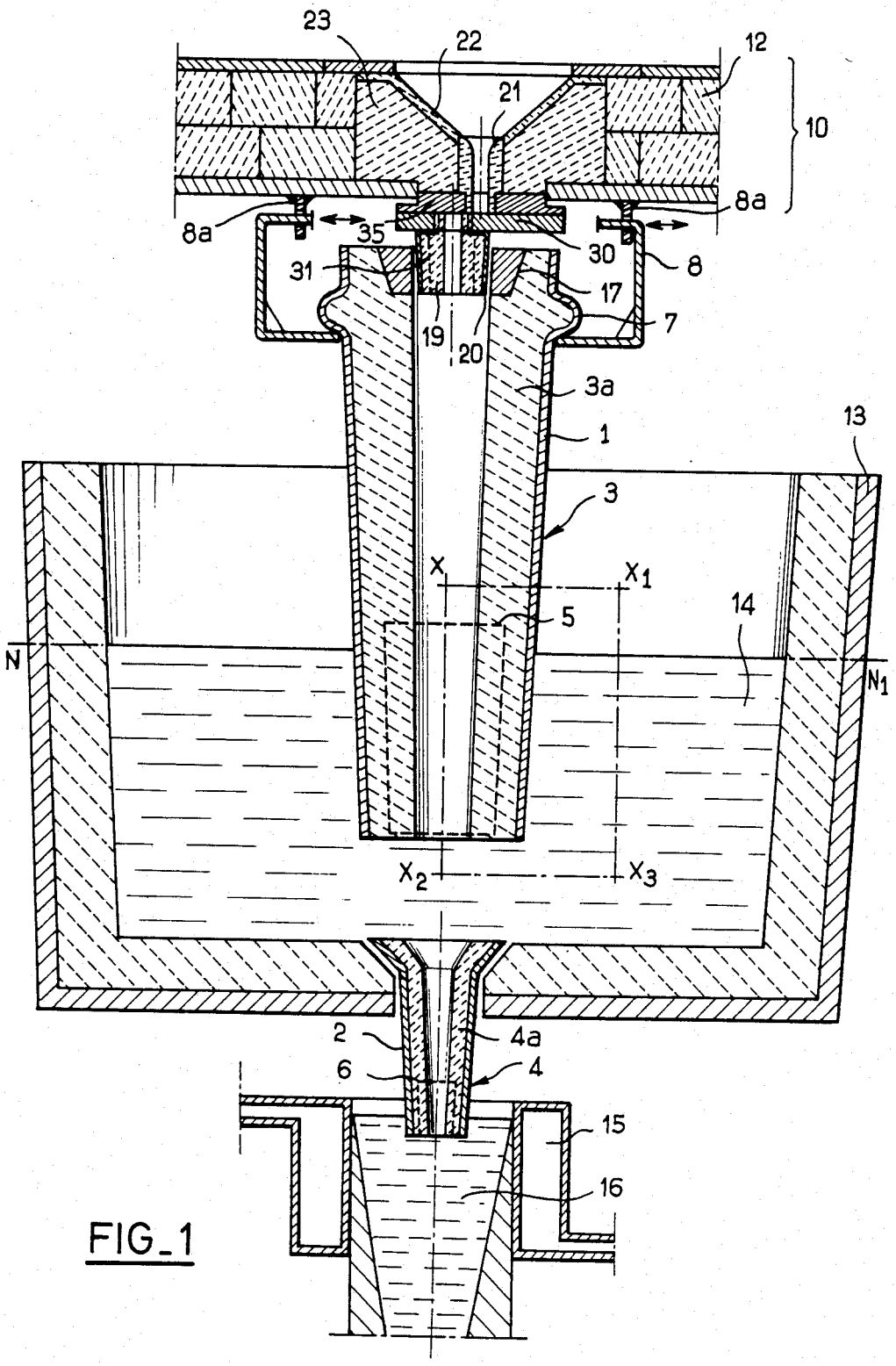
FIG. 1 is an axial sectional view of a casting system comprising three casting tubes or nozzles in accordance with the invention.

In FIG. 1, which illustrates a complete continuous-casting system, there is shown at 10 the base of the casting ladle with its refractory lining 12, the element of sinterable heat-insulating refractory lining 12, the element of sinterable heat-insulating refractory material being designated by the reference 22 and the seating brick for the fixed nozzle 21 being designated by the reference 23.

The orifice of the nozzle 21 can be closed-off by means of a slide-valve, the movable plate of which is shown at 30 and the stationary plate of which is shown at 35, both plates being pierced by an orifice through which the molten metal passes. The slide-valve is shown in the closed position in FIG. 1.

Beneath said slide-valve is placed the casting tube 3 which is capable of sliding transversely with respect to its axis at the same time as the plate 30, and a small removable connecting nozzle 19 which is mounted in air-tight manner by means of a refractory cement seal between the plate 30 for mounting said nozzle and the top portion of the casting tube 3 in which it is engaged. In the example shown, the small nozzle 19 is applied against a metallic and/or refractory internal reinforcement ferrule 17 arranged at the top of the casting tube 3.

The assembly formed by the moving parts mentioned above is guided in transverse sliding motion relative to the axis of the casting tube 3 by a support 8 which is capable of displacement in translational motion (as shown by the arrows), said support being in turn guided by stationary lugs 8*a*. The aforesaid assembly of parts constitutes a slide-valve system.

The casting tube 3 is located between the ladle 10 and the tundish 13 which in turn carries a small casting tube or nozzle 4. Said nozzle can also form part of a slide-valve system and is located between the tundish 13 and the continuous-casting ingot-mold 15.

In the example considered, the invention is applied both to the casting tubes 3 and 4 and to the connecting nozzle 19.

The tubes 3 and 4 are thus constituted respectively by a sheet-metal cladding element 1 and 2 having a small thickness of the order of one millimeter. In the case of the casting tube 3, the thin sheet-metal cladding 1 has an annular boss 7 which is intended to bear on the sliding support 8.

The metal cladding 1 and 2 are each lined with an acid or basic sinterable heat-insulating material 3*a* and 4*a* having a density which can vary between 0.7 and 2.

EXAMPLE I

An acid formula can contain:

$SiO_2$: . . . 80 to 95%
CaO: . . . 0 to 2%
$Al_2O_3$: . . . 0 to 2%
binder such as:
phenol-formol,
urea-formol or
synthetic resin: . . . 0.5 to 3% organic fibers: . . . 0 to 3%
residual water: . . . traces, wastage of the material by burning being advantageously less than 6%.

EXAMPLE II

A suitable basic formula for the lining 3 is as follows:

MgO: . . . 60 to 90%
CaO: . . . 0 to 3%
$SiO_2$: . . . 0 to 20%
$Fe_2O_3$: . . . 0.5 to 3%
Binder: (as above) . . . 0.5 to 3%
Organic fibers: . . . 0 to 3%
Residual water, wastage by burning being advantageously less than 6%, In accordance with the invention, an internal reinforcement member 5 and 6 is incorporated respectively within the lining 3*a* and 4*b* of the tubes 3 and 4. The action of the said reinforcement member is combined with that of the metal cladding 1 or 2 of the tube considered.

The internal reinforcement member 5 or 6 can preferably be made from carbon fibers, graphite fibers, ceramic fibers, such as kaolin or alumina fibers, mineral fibers such as glass, rock fibers and mixtures thereof. These fibers can be woven or non woven. These fibers are incorporated in the lining of sinterable material by using the method described in U.S. Pat. No. 4,432,396. When a certain thickness of the sinterable material of the lining is obtained, the end of the casting tube is dipped in a water suspension of fibers, containing eventually an inorganic or organic binder, then a second layer of sinterable material is formed on the fibrous layer.

The reinforcement member thus obtained has a high mechanical strength with respect to the tube-lining material in which it is incorporated. Furthermore, no cracks are observed in the tube-lining material due to the heat of the metal passing in the tube. The thickness of the internal reinforcement member is advantageously within the range of 0.3 to 15 mm as a function of the thickness of the lining 3*a* or 4*a* of the casting tube.

In the case of both of the tubes 3 and 4, the height of the internal reinforcement members 5 and 6 is such that it reaches—or preferably extends above—the top level of the molten metal which is being cast and comes into contact with the exterior of the tube.

Figure 3:
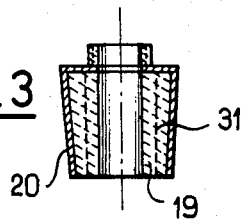
FIG. 3 is an axial sectional view to a larger scale and showing an element of FIG. 1.

In the advantageous embodiment hereinabove described, the small removable connecting nozzle 19 of the casting tube 3 is also constructed in accordance with the present invention and is provided (as shown in FIG. 3) with an internal reinforcement member 31 which is similar to the reinforcement members 5 and 6 and extends throughout the height of said nozzle. The connecting nozzle 19 is thus composed of a solid and/or perforated metal jacket 20 lined internally with suitable refractory insulating material 19*a* which is similar to the internal linings 3*a* and 4*a* and in which the internal reinforcement member 31 is embedded.

As shown in FIG. 1, the tundish 13 is filled with molten metal 14 up to the level N-N1. The continuous-casting ingot mold 15 is shown with its metal ingot 16 in process of solidification.

Figure 2:
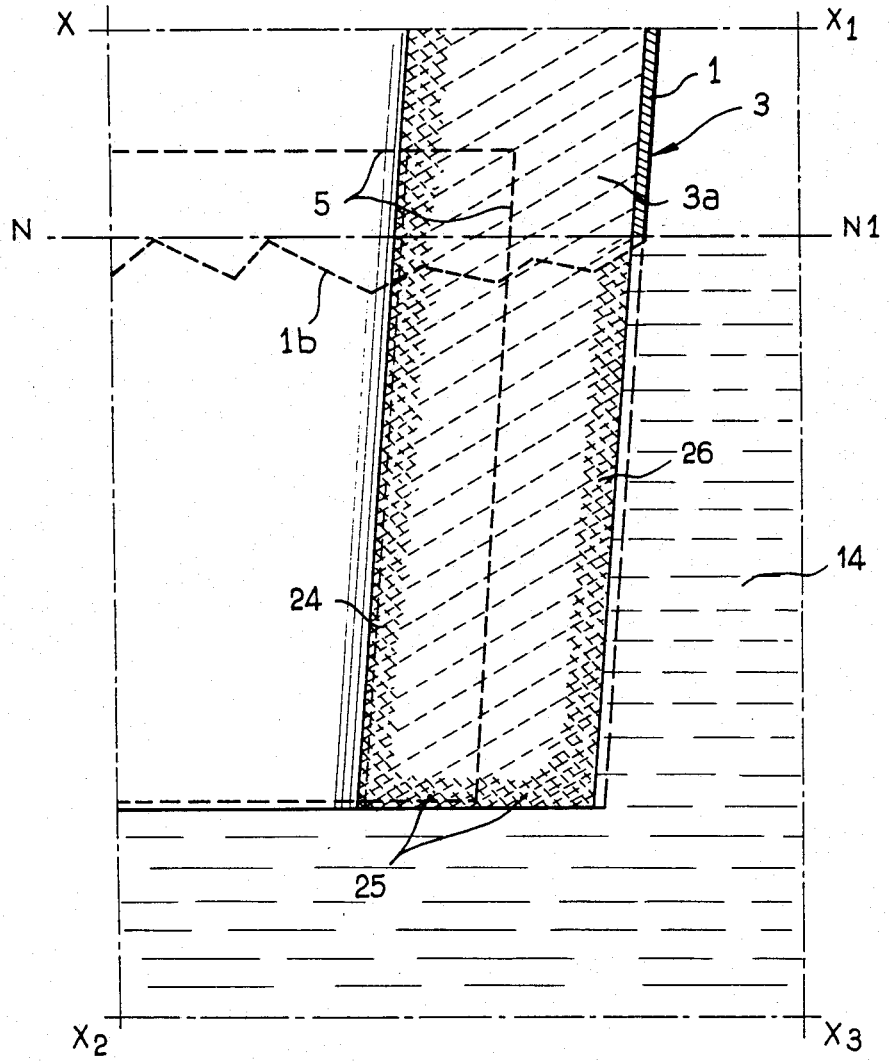
FIG. 2 is a view to a larger scale showing the portion located between the lines $X—X_1$ and $X_2—X_3$ of an element of FIG. 1.

The mode of action of the means proposed by the invention has been demonstrated by practical experience and will now be explained with reference to FIG. 2.

Consideration will be given to the case of the casting tube 3 since the casting nozzle 4 is identical and the operating conditions are fairly similar to the case of the connecting nozzle 19.

In that portion of the casting tube 3 which dips into the steel bath, the tubular region 26 forming part of the lining 3*a* and located behind the thin sheet-metal cladding 1 is capable of sintering only when the corresponding portion of said sheet-metal cladding 1 has melted approximately along the line 1*b* located in the vinicity of the level N-N1.

The face 25 corresponding to the bottom edge of the tube sinters freely since it dips into the molten steel bath 14 without hindrance.

The internal face 24 of the casting tube which is substantially in contact with the jet of metal sinters progressively during the sequential casting operation of operations until the sintering process reaches the sintered portion 26. This progressive sintering of the mass of the lining material 3*a* is made possible only by the internal reinforcement member 5 which, while strengthening the immersed portion of the casting tube, enables said tubes to undergo this transformation without any attendant danger of fracture.

FIG. 1 illustrates the casting tubes 3 and 4 immediately before the lower portion of their sheet-metal cladding 1 and 2 has melted.

When the lower portion of the metal cladding has melted along the line 1*b*, the degree of development attained by the sintering process at this moment is not usually sufficient to permit the immersed end of the tube (which is assumed to be homogenous) to offer resistance to the effect of internal pressure and to the turbulent movements which take place in the molten steel at this point.

It is precisely for the reason just given that, during this time interval, the internal reinforcement members such as those which are designated by the references 5, 6 or 31 and which are embedded within the sinterable material take over and ensure the necessary continuation to permit completion of the sintering process without any interruption. Breaking-away of the immersed end of the tube which usually took place along the line 1*b* is accordingly suppressed, thus preventing any contact between the molten metal and the surrounding air.

As can readily be understood, the internal reinforcement member provided by the invention must be adapted to the shape of the casting tube while remaining coaxial with this latter.

The internal reinforcement member 5, 6 or 31 can also be made from refractory particles joined together by the means of binder, said particles being chosen among the group comprising $SiO_2$ or MgO as main components, CaO, $Al_2O_3$, $Fe_2O_3$, wherein, when the lining of the casting tube contains as main component $SiO_2$ and is of acid nature, the tubular reinforcement layer contains MgO as main component and is of basic nature and wherein, when the lining of the casting tube contains as main component MgO and is of basic nature, the tubular reinforcement layer contains $SiO_2$ as main component and is of acid nature.

In other words, when the composition of the sinterable lining of the tube is acid (see above example I), the composition of the internal reinforcement layer 5, 6, 31 will be basic i.e that of above example II; when the composition of the sinterable lining of the tube is basic (example II), the composition of the internal reinforcement layer 5, 6, 31 with be acid (example I).

Alternatively the internal reinforcement member 5, 6, or 31 can also be made from metal particles chosen among the group comprising Mg, Fe, Zn, Ca, Mn, Co, Ni and mixtures thereof mixed with $Al_2O_3$, said mixture being converted into a double oxide of aluminum and of the metal(s) chosen among the above group under the heat involved by the molten metal casted into the casting tube.

When for example the metal particles are Mg, under the heat involved at the casting temperature, the layer composed of Mg and $Al_2O_3$is converted into a spinel which withstands a temperature up to 2135° C. and which reinforces considerably the lining of the casting tube.

In the case where the reinforcement layer is constituted by fibers or refractory particles, it is advantageous to mix with the same, metallic particles such as metallic power or wires. The effect of these metallic particles is to obtain a uniform temperature at the end of the tube, said uniform temperature being favourable to prevent any crack formation in the tube lining.

What is claimed is:

1. A casting tube for liquid metal, comprised by a thin sheet-metal cladding and an internal unfired lining of heat-insulating material comprising inorganic particles which are embedded in an organic binder, said inorganic particles being sinterable under the action of the heat of the liquid metal as it flows within said tube, the upper end of said casting tube being attached in an air-tight manner to the discharge outlet of a first vessel for containing molten metal, the lower end of the casting tube being immersed in molten metal in a second vessel located downstream with respect to said first vessel, and a tubular unfired reinforcement member embedded within the lining material and covered on all its faces with the lining material, said tubular reinforcement member extending to at least the full depth of that portion of the casting tube which is in contact with the molten metal in the second vessel, the reinforcement member comprising a layer of finely divided material completely embedded in said lining material, said finely divided material being more refractory than said internal lining material and having a mechanical strength higher than that of said internal lining material, said tubular reinforcement member comprising a tubular layer of refractory fibers selected from the group consisting of carbon fibers, graphite fibers, ceramic fibers, mineral fibers and a mixture thereof.

2. A casting tube as claimed in claim 1, in which said reinforcement member extends upwardly from the lower end of said casting tube only a minor portion of the height of the casting tube.

3. A casting tube for liquid metal, comprised by a thin sheet-metal cladding and an internal unfired lining of heat-insulating material comprising inorganic particles which are embedded in an organic binder, said internal lining of the casting tube containing MgO as its main component and being of basic nature, said inorganic particles being sinterable under the action of the heat of the liquid metal as it flows within said tube, the upper end of said casting tube being attached in an air-tight manner to the discharge outlet of a first vessel for containing molten metal, the lower end of the casting tube being immersed in molten metal in a second vessel located downstream with respect to said first vessel, and a tubular unfired reinforcement member embedded within the lining material and extending to at least the full depth of that portion of the casting tube which is in contact with the molten metal in the second vessel, the reinforcement member comprising a layer of finely divided material completely embedded in said lining material, said finely divided material being more refractory than said internal lining material and having a mechanical strength higher than that of said internal lining material, said tubular reinforcement member comprising a tubular layer of finely divided refractory particles joined together by a binder, the tubular reinforcement layer containing $SiO_2$ as its main component and being of acid nature.

4. A casting tube as claimed in claim 3, in which said reinforcement member extends upwardly from the lower end of said casting tube only a minor portion of the height of the casting tube.

5. A casting tube for liquid metal, comprising a thin sheet-metal cladding and an internal unfired lining of heat-insulating material comprising inorganic particles which are embedded in an organic binder, said inorganic particles being sinterable under the action of the heat of the liquid metal as it flows within said tube, the upper end of said casting tube being attached in an air-tight manner to the discharge outlet of a first vessel for containing molten metal, the lower end of the casting tube being immersed in molten metal in a second vessel located downstream with respect to said first vessel, and a tubular unfired reinforcement member embedded within the lining material and extending to at least the full depth of that portion of the casting tube which is in contact with the molten metal in the second vessel, the reinforcement member comprising a layer of finely divided material completely embedded in said lining material, said finely divided material being more refractory than said internal lining material and having a mechanical strength higher than that of said internal lining material, said tubular reinforcement member comprising a mixture of $Al_2O_3$ and metal particles selected from the group consisting of Mg, Fe, Zn, Ca, Mn, Co, Ni and a mixture thereof, said mixture of $Al_2O_3$ and metal particles being adapted to be converted into a double oxide of aluminum and of said selected metal under the heat of the molten metal cast into the casting tube.

6. A casting tube as claimed in claim 5, in which said reinforcement member extends upwardly from the lower end of said casting tube only a minor portion of the height of the casting tube.

7. A casting tube for liquid metal, comprised by a thin sheet-metal cladding and an internal unfired lining of heat-insulating material comprising inorganic particles which are embedded in an organic binder, said internal lining of the casting tube containing $SiO_2$ as its main component and being of acid nature, said inorganic particles being sinterable under the action of the heat of the liquid metal as it flows within said tube, the upper end of said casting tube being attached in an air-tight manner to the discharge outlet of a first vessel for containing molten metal, the lower end of the casting tube being immersed in molten metal in a second vessel located downstream with respect to said first vessel, and a tubular unfired reinforcement member embedded within the lining material and extending to at least the full depth of that portion of the casting tube which is in contact with the molten metal in the second vessel, the reinforcement member comprising a layer of finely divided material completely embedded in said lining material, said finely divided material being more refractory than said internal lining material and having a mechanical strength higher than that of said internal lining material, said tubular reinforcement member comprising a tubular layer of finely divided refractory particles joined together by a binder, the tubular reinforcing layer containing MgO as its main component and being of basic nature.

8. A casting tube as claimed in claim 7, in which said reinforcement member extends upwardly from the lower end of said casting tube only a minor portion of the height of the casting tube.

* * * * *